US006183557B1

(12) United States Patent
Kuo

(10) Patent No.: US 6,183,557 B1
(45) Date of Patent: Feb. 6, 2001

(54) AIR BELLOW SUSPENDED PIPE LINING MACHINE

(75) Inventor: Ming C. Kuo, Cerritos, CA (US)

(73) Assignee: Ameron International, Corp., Pasadena, CA (US)

( * ) Notice: Under 35 U.S.C. 154(b), the term of this patent shall be extended for 0 days.

(21) Appl. No.: 09/161,551

(22) Filed: Sep. 25, 1998

(51) Int. Cl.[7] ..... B05C 7/08
(52) U.S. Cl. ..... 118/55; 425/433
(58) Field of Search ..... 118/55; 427/230, 427/231, 233, 234, 290; 169/280; 425/433; 198/813, 814, 817

(56) References Cited

U.S. PATENT DOCUMENTS

| | | | | |
|---|---|---|---|---|
| 1,676,815 | | 7/1928 | Beatty . | |
| 1,837,324 | * | 12/1931 | Hume | 118/55 |
| 1,865,692 | | 7/1932 | Hume . | |
| 2,641,218 | * | 6/1953 | Burwell | 118/55 |
| 3,098,764 | | 7/1963 | Kao et al | 118/55 |
| 4,112,850 | | 9/1978 | Sigei-Gfeiler | 104/138 |
| 4,597,995 | * | 7/1986 | Snow et al. | 118/55 X |
| 4,908,006 | | 3/1990 | Burysek et al. | 474/117 |
| 5,277,666 | | 1/1994 | Kumm | 474/133 |
| 5,413,638 | | 5/1995 | Bernstein, Jr. et al. | 118/620 |
| 5,458,051 | * | 10/1995 | Alden et al. | 198/813 |
| 5,511,650 | * | 4/1996 | Hurworth | 198/813 |
| 5,660,266 | * | 8/1997 | Nolte | 198/711 |
| 5,763,004 | * | 6/1998 | Hammen | 427/236 X |

FOREIGN PATENT DOCUMENTS

| | | | | |
|---|---|---|---|---|
| 1275281 | * | 8/1968 | (DE) | 118/55 |

* cited by examiner

*Primary Examiner*—Laura Edwards
(74) *Attorney, Agent, or Firm*—Christie, Parker & Hale, LLP

(57) ABSTRACT

A belt assembly for a pipe lining machine used to make concrete lined pipes. A pipe to be rotated is supported on the exterior surface of a belt loop wound around several pulleys, including a drive pulley and a displaceable pulley which moves laterally in response to slack and tension in the belt loop. A damping assembly is connected to the displaceable pulley to damp vibrations in the displaceable pulley. Preferably, the damping assembly includes a pneumatic suspension member, e.g., air bellows, and a hydraulic damping member, e.g., a hydraulic shock-absorbing cylinder, connected in series to the displaceable pulley.

24 Claims, 3 Drawing Sheets

AIR BELLOW SUSPENDED PIPE LINING MACHINE

FIELD OF THE INVENTION

The present invention is directed to a suspension system for a pipe lining machine and more particularly, to a damping assembly for damping vibrations in the belts used to support and rotate pipes during the lining operation.

BACKGROUND OF THE INVENTION

Concrete-lined pipes of exceptionally large diameter are generally used as buried conduits for conducting drinking water, irrigation water, and other fluids. To construct such a pipe, concrete mortar is placed inside a steel pipe which is then spun to centrifugally distribute the concrete mortar in an even thin layer on the inside wall of the pipe.

A machine, generally known as lining machine, is used to perform the operation and basically consists of multiple belt assemblies, usually three to five, which are spaced apart for supporting the pipe along its length. A side view of a pre-existing lining machine 10 is illustrated in FIG. 1. The side view shows the typical belt arrangement for each belt assembly of the lining machine. Each belt 12 is formed into a loop which wraps around a set of four pulleys, as depicted in FIG. 1.

The pipe is supported by the belts at the portion between the two upper pulleys 14, 16. The left upper pulley 14 is generally fixed in position and powered by a drive motor to provide the necessary drive force to spin the pipe at sufficient rotational speeds to adequately pack the mortar on the inside wall of the pipe. The right upper pulley 16 can be adjusted toward or away from the left pulley before the spinning operation to adapt the machine to a range of pipe sizes. The right lower pulley 20 may also be adjusted. The left lower pulley 18 is fixed in position. All pulleys are fixed in position during operation.

To mortar line a pipe, the pipe is initially rotated at a steady but relatively low speed and a mortar feeding lance is moved inside the pipe to pour the mortar material along the length of the pipe. The pipe is then accelerated to a desired rotational speed to pack the mortar against the internal pipe wall for a sufficient period of time to allow the mortar to dewater.

Due to the elastic property of the belts, the generally uneven roundness of the pipe, and the imbalance in the pipe caused by an uneven mortar thickness caused by the rotation of the pipe around its mass (i.e., gravity) center, the pipe vibrates on the belts while it is rotating. The pipe and the belts together constitute an oscillating system with a particular frequency of its own, its so-called "natural frequency." When the pipe is rotated at high speeds, the reciprocating movements of the belts come into the natural frequency range of this system. When this happens, the pipe and belts tend to move independently of the motion imparted to them by the drive motor.

The vibration of the system is especially large when in the natural frequency of the system before reaching the packing speed. If the pipe is excessively out of balance, the vibration can be very severe and the pipe can bounce off of the belts, causing the belts to slack and sometimes slip away from the pulleys. This damages the belts and may also cause the pipe to fall off of the machine, thereby creating a dangerous situation for both the equipment and human operators of the lining machine.

Accordingly, it would be desirable to provide means for dampening the vibration of the system during the spinning operation for the safety of the machine and its operators.

SUMMARY OF THE INVENTION

According to one embodiment of the invention, a pipe lining machine including several belt assemblies for supporting a pipe to be rotated is provided. The pipe lining machine also includes a base, a drive motor, and several connecting arms for each belt assembly. The connecting arms are connected at a bottom end to the base. At least one of the connecting arms per belt assembly is hingeably connected to the base. Each belt assembly includes several pulleys, each connected to the top end of each of the connecting arms. The pulleys include a drive pulley operatively connected to the drive motor and a movable pulley connected to the connecting arm hingeably connected to the base. A belt formed into a belt loop is wound around the pulleys. An interior surface of the belt loop contacts the pulleys and an exterior surface of the belt loop supports a pipe to be rotated. Means are provided for damping movement of the movable pulley.

According to another embodiment, the means for damping movement of the moveable pulley is a damping assembly operatively coupled to the moveable pulley. Preferably, the damping assembly includes a pneumatic suspension member, e.g., an air bellows, coupled to the moveable pulley, and a hydraulic damping member, e.g., a hydraulic cylinder, coupled to the moveable pulley and to the pneumatic suspension member.

DESCRIPTION OF THE DRAWINGS

This invention may be better understood and its numerous objectives and advantages will become apparent to those skilled in the art by reference to the following drawings.

DETAILED DESCRIPTION OF THE INVENTION

Figure 1:
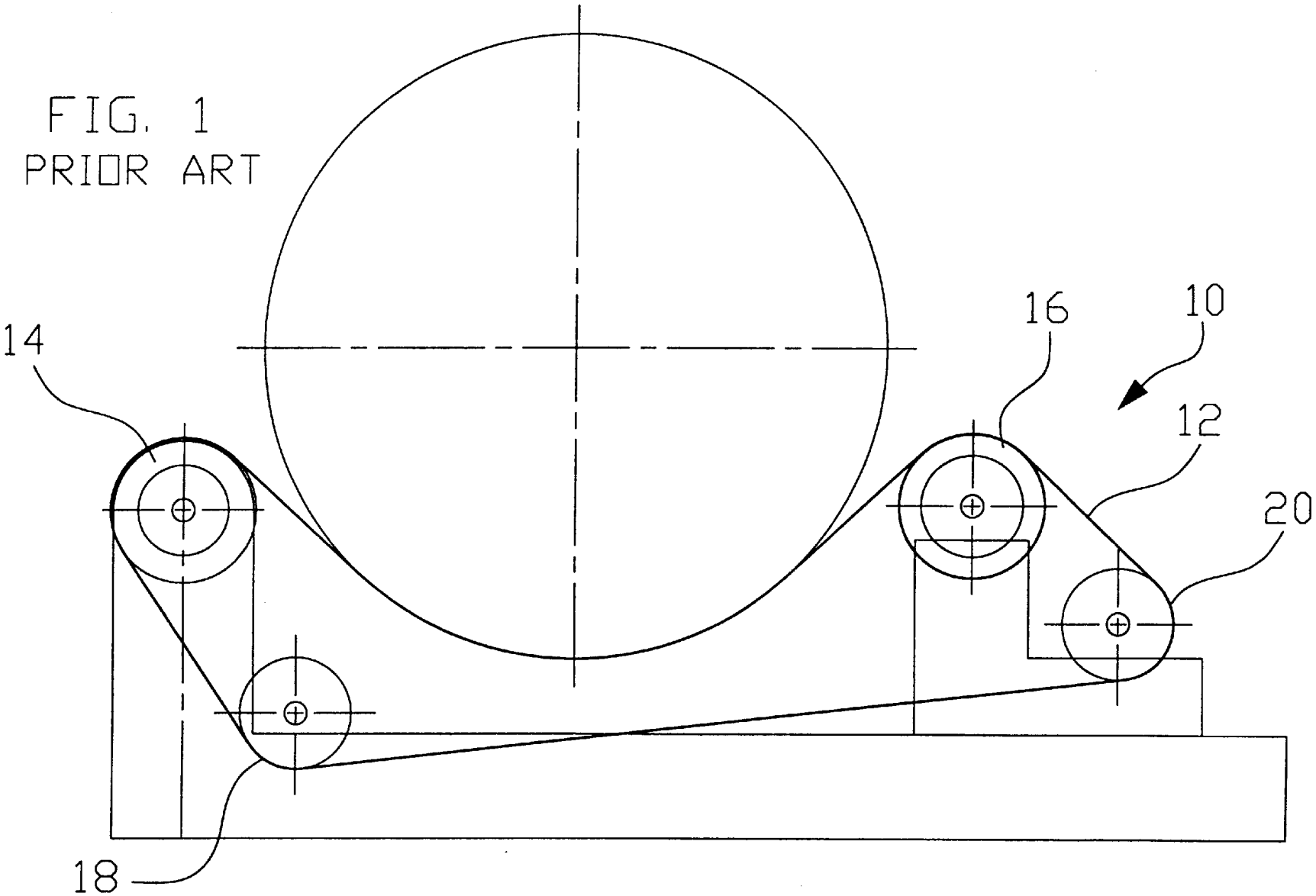
FIG. 1 PRIOR ART
FIG. 1 is a side view of a pre-existing pipe lining machine.
Figure 2:
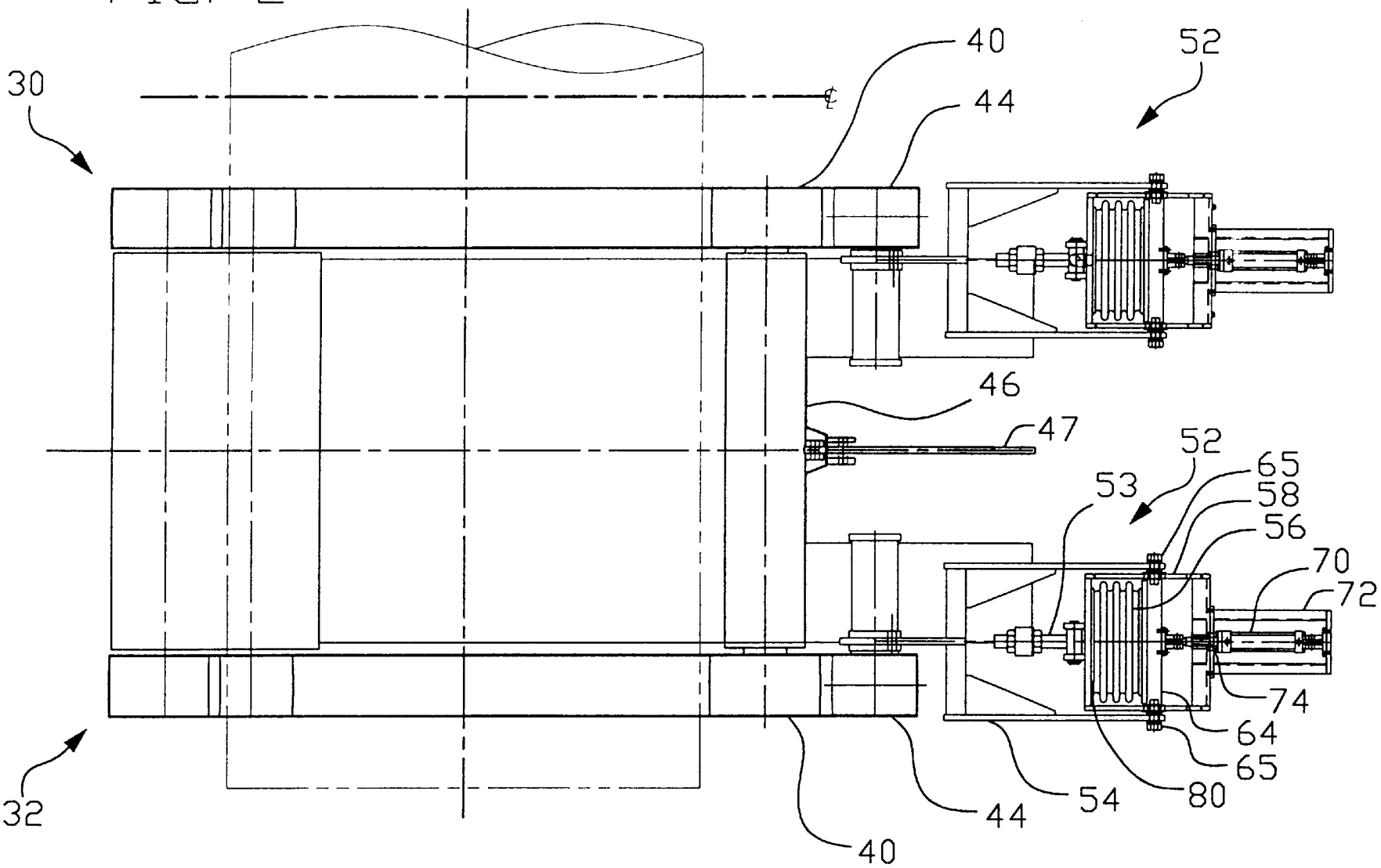
FIG. 2 is a plan view of a pipe lining machine according to one embodiment of the invention.

FIG. 2 illustrates one embodiment of the invention, which includes two pairs of belt assemblies adapted to support a pipe such that it is free to rotate. A pair of the belt assemblies is typically positioned on either end of the pipe. Only one pair of the belt assemblies is illustrated in FIG. 2. The other belt assemblies are substantially the same in their construction, mounting, and operation. Hence, the separate parts herein indicated by reference as applied to the pair of belt assemblies 30, 32 are equally applicable to the other pair of belt assemblies (not shown).

Figure 3:
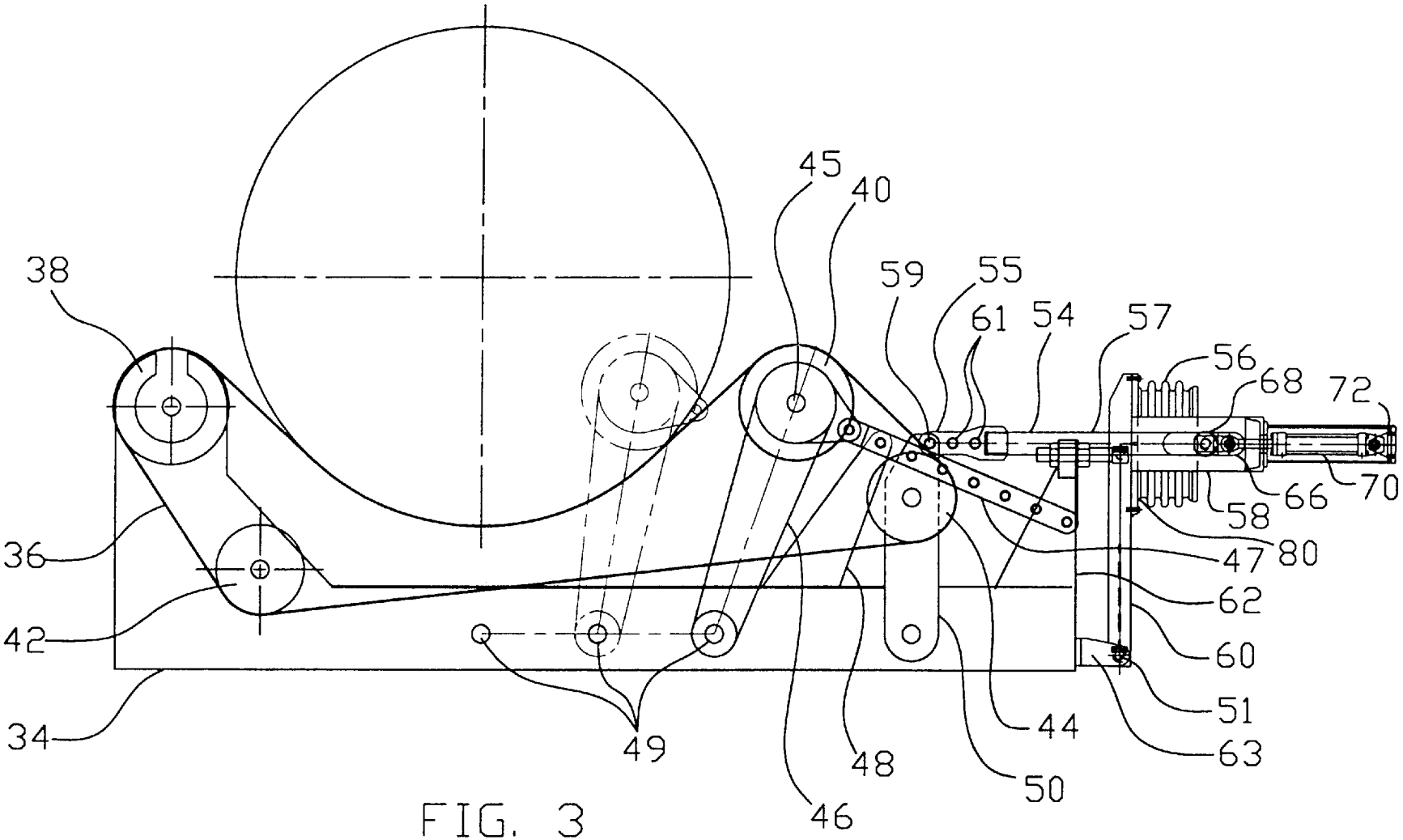
FIG. 3 is a side view of the pipe lining machine shown in FIG. 2.

Each pair of belt assemblies share a common base 34 (FIG. 3). Each belt assembly includes a belt loop 36 wound around four pulley pairs: left upper 38; right upper 40; left lower 42; and right lower 44. Power is applied to rotate a power pulley, in this embodiment the left upper pulley 38, to thereby rotate the belt and thus the pipe. Each of the belt assemblies will have the same corresponding power pulley. The locations of the axles of the power pulleys are fixed relative to the base. Preferably a 150 hp drive motor (not shown) is used to drive the power pulley in each of the belt assemblies. A preferable drive motor is capable of rotating pipes weighing up to 20 tons, which may rotate at speeds up to 100 mph at the pipe edge when at the packing speed.

The pair of right upper pulleys 40 are rotated on a common axle 45 which is mounted in an adjustable pulley supporting arm 46. The adjustable pulley supporting arm 46 is adjustable at its upper and lower ends to accommodate pipes of different size on the belt loop 36. The upper end of the adjustable pulley supporting arm 46 is attached with pins to one end of a connecting bar 47. At a point spaced from that one end, the bar is also connected to the upper end of a pedestal 48 built on the base 34. The connecting bar 47 can be connected to the upper end of pedestal 48 with a pin through one of a series of holes along its length to adjust the position of the right upper pulleys 40 for relatively minor changes in pipe size.

The lower end of the adjustable pulley supporting arm 46 is hingeably connected to the base. It can be connected to one of the two or more holes 49 provided in the base to adjust for a major change in pipe size. Holes 49 are located laterally along the base at positions that are spaced various distances from the left pulleys.

The left lower power pulley 42 is fixed in position. Each pulley forming the right lower pulley pair 44 is supported by a hinged pulley supporting arm 50 which is hingeably connected at its lower end to the base 34.

The upper end of each hinged pulley supporting arm 50, which extends above the pulley, is connected to a damping assembly 52 by a fork-shaped link (or a yoke) 54. Preferably, each hinged pulley supporting arm is pivotally connected using a pin 59 to a hole 61 in tongue 55 connected to the base 57 of the fork-shaped link. Preferably, the tongue has a series of holes 61 along its length. The pulley supporting arm 50 can be connected to any such hole 61 using a pin. As such, the position of the hinged pulley arm can be adjusted.

Each damping assembly includes air bellows 56 positioned inside a housing 58. A front end 80 of the air bellows is secured to the housing structure. The housing 58 has a supporting leg 60 extending downward and connected with a pin 51 to an arm 63 extending from the base 34. Near its upper end, the housing is secured by an eye bolt 53 to another pedestal 62 which is preferably built on the base.

The forked double arms of the link 54 extend around the bellow housing and connect with each end 65 of a shaft 64 transversely secured to the rear end of the air bellows. The shaft ends 65 extend through a slot opening 66 on each of the side walls of the housing. A wheel 68 is mounted at each end of the shaft inside the link and rides in a corresponding one of these slot openings inside the link.

When each bellows is inflated with air pressure, it pulls its corresponding lower pulley 44 via the fork-shaped link and stretches (i.e., tensions) the belt to lift and support the pipe. Before the belt is driven with a pipe in place, the bellows should be inflated with air pressure to a level positioning the shaft wheels 68 midway along the slots 66. In this regard, the bellows will be able to oscillate as necessary in either direction along the slot 66. The bellows work as a suspension and tensioning device to take up the belt slack when the pipe vibrates.

A hydraulic cylinder 70 is mounted in an extended housing 72 secured to the rear side of each of the bellows housing 58. A cylinder rod 74 extending from the hydraulic cylinder is connected transversely to the shaft 64. The rod is connected on the side of the shaft opposite the bellows. The hydraulic cylinder provides resistance to the movement of the shaft which, ideally, is proportional to the velocity of the force attempting to move the shaft. The cylinder is filled with hydraulic fluid and its ports are connected to a system of control valves (not shown) for damping down vibration. Such valves and their operation are known in the art. One of the control valves is preferably a throttling valve that is set to relieve fluid pressure generated in the cylinder by the movement of the shaft, and thus, decrease the resistance provided by the cylinder when a force equal to or greater than a preselected magnitude is applied to the shaft. This pressure relief setting is preferably set to correspond to a force less than 25% of the pipe weight.

According to a preferred embodiment of the present invention, the hinged lower right pulley 44 moves laterally in response to slack and vibrations in the belt loop 36 caused by the vibrating pipe. As the lower right pulley 44 moves laterally, it moves the fork-shaped link 54 which causes the shaft 64 to move along the slot openings 66 formed on the bellows housing 58 sidewalls. The movement of the shaft and thus, of the lower right pulley, is resisted by the air bellows and the hydraulic cylinder which are coupled on opposite sides of the shaft. The bellows and the hydraulic cylinder resist movement of the shaft and thus, of the lower right pulley, toward the center of the pipe (i.e., the movement compressing the bellows). In other words, the bellows resists the belt detensioning movement of the lower right pulley. Such movement is caused by the weight of the pipe or when the pipe bounces on the belt. When the pipe bounces off the belt, the bellows expands in a direction keeping the tension of the belt on the pipe so as to keep the belt in contact with the pipe.

To mortar line a steel pipe, the pipe is rotated at a steady lower speed and a mortar feeding lance is moved along the length of the interior of the pipe to pour the mortar material into the pipe. The pipe is then accelerated to a desired speed for a sufficient period of time to pack the mortar against the pipe wall and to remove the excess water from the mortar.

As a rule, the pipe is not perfectly round and hence rotates about its mass center rather than its geometric center which results in an eccentric rotation. During rotation of the pipe, the belt itself acts as a low mass spring and responds to high frequency, low amplitude vibrations caused by the eccentric rotation of the pipe. The pipe and the belt together constitute an oscillating system with a particular natural frequency. When the pipe is rotated at high speeds, the reciprocating movements of the belt come into the natural frequency range of this system. The oscillations associated with the natural frequency are experienced along a range of rotational speeds evenly distributed about the rotational speed at which true natural frequency of the system occurs. For example, if the true natural frequency of the system occurs at 50% of the packing speed, the range at which oscillations associated with the natural frequency will be experienced by the system is in the range of about 40% to 60% of the packing speed.

When in operation, the bellows acts as a support for supporting the weight of the pipe. In essence, the belt in combination with the bellows acts as a two spring system with the two springs in series. The bellows can be expanded as necessary by filling with air to support heavier or lighter pipes.

As the pipe rotates and jumps on the belt, the minor vibrations are absorbed by the stretching of the belts. Large amplitude vibrations are absorbed by the bellows. As the impact on the belt by the pipe increases, the larger amplitude vibrations are damped by the hydraulic cylinder which acts as a shock absorber.

It has been found that the action of the air bellows actually lowers the natural frequency of the system. The hydraulic cylinder which acts as a shock-absorbing device further damps the vibration and reduces oscillation at the natural frequency of the system. This results in a smoother ride for the pipe with better lining quality and a longer belt life. This damping action also makes the machine safer to operate. Moreover, the natural frequency of the system is reached at lower rpms. This is advantageous in that it makes it easier for the motor to drive the spinning pipe through the natural frequency of the system. Furthermore, the packing speeds are isolated further away from the rotational speeds at which the natural frequency occurs and hence the system is less affected by the excess vibrations created in the system when near its natural frequency.

What is claimed is:

1. A belt assembly for a pipe lining machine comprising:

a base;

a drive motor;

a plurality of connecting arms connected at a bottom end to the base and including at least one arm hingeably connected to the base;

a plurality of pulleys coupled to the base, including a drive pulley operatively connected to the drive motor and a movable pulley hingeably coupled to the base;

a belt formed into a belt loop wound around the plurality of pulleys, the belt loop having an interior surface contacting the pulleys and an exterior surface for supporting a pipe to be rotated; and means for damping movement of the movable pulley for damping bouncing of the pipe when rotated.

2. The belt assembly of claim 1 wherein the damping means comprises a damper and a suspension member operatively coupled to the movable pulley.

3. The belt assembly of claim 2 wherein the suspension member is a pneumatic member operatively coupled to the movable pulley.

4. The belt assembly of claim 3 wherein the pneumatic suspension member is an air bellows.

5. The belt assembly of claim 3 wherein the pneumatic suspension member resists belt detensioning movements of the moveable pulley.

6. The belt assembly of claim 2 wherein the damper is a hydraulic damping member coupled to the suspension member.

7. The belt assembly of claim 6 wherein the hydraulic damping member is a shock-absorbing hydraulic cylinder.

8. The belt assembly of claim 6 wherein the hydraulic member resists belt detensioning movements of the moveable pulley.

9. The belt assembly of claim 1 wherein the damping means comprises:

a suspension member for reducing vibrations; and a damper for absorbing shock.

10. A pipe lining machine comprising:

a belt assembly upon which a pipe to be rotated is supported, the belt assembly comprising:

a base;

a plurality of pulleys, each connected to the base by an associated connecting arm;

a belt loop wrapped around the plurality of pulleys, wherein one of said pulleys is displaceable in response to slack and tension in the belt loop;

a drive motor operatively connected to at least one of the pulleys;

a suspension member operatively coupled to the displaceable pulley; and a damper operatively coupled to the suspension member.

11. The pipe lining machine of claim 10 wherein the suspension member and damper resist belt detensioning movements of the displaceable pulley.

12. The pipe lining machine of claim 10 wherein the suspension member is an air bellows and the damping member is a hydraulic cylinder including a cylinder rod, wherein the damper is located opposite the suspension member.

13. The pipe lining machine of claim 12 wherein a shaft having two opposite ends is laterally connected to a rear portion of the air bellows and to the hydraulic cylinder rod.

14. The pipe lining machine of claim 13 wherein the air bellows is mounted in a housing having two opposing sides.

15. The pipe lining machine of claim 14 wherein the two opposing sides of the housing have slotted openings, and wherein the shaft has a wheel on each of the two ends, each wheel tracking on a slotted opening.

16. A belt assembly for a pipe lining machine comprising:

a base;

a set of pulleys wherein at least one of the pulleys is hingeably coupled to the base, and wherein the at least one hingeably coupled pulley can move relative to the base;

a drive motor for driving at least one of the pulleys;

a belt surrounding the pulleys for supporting and rotating a pipe; and a damper coupled to the at least one hingeably coupled pulley for damping the movement of the at least one hingeably coupled pulley.

17. A belt assembly as recited in claim 16 wherein the damper comprises an air bellows.

18. A belt assembly as recited in claim 17 wherein the damper further comprises a hydraulic shock absorbing cylinder.

19. A belt assembly as recited in claim 18 wherein the bellows is opposite the cylinder and wherein the at least one hingeable pulley is coupled to the bellows and the cylinder at a location between the bellows and the cylinder.

20. A belt assembly for a pipe lining machine comprising:

a base;

a set of pulleys wherein at least one of the pulleys is hingeably coupled to the base, and wherein the at least one hingeably coupled pulley can move relative to the base;

a drive motor for driving at least one of the pulleys;

a belt surrounding the pulleys for supporting and rotating a pipe; and means coupled to the at least one hingeably coupled pulley for moving the at least one hingeably coupled pulley position to maintain the belt in continuous contact with the pipe as the pipe is rotating.

21. A belt assembly as recited in claim 20 wherein the means comprises an air bellows coupled to the at least one hingeably coupled pulley and to the base.

22. A belt assembly for a pipe lining machine comprising:

a base;

a drive motor;

a plurality of connecting arms connected at a bottom end to the base and including at least one arm hingeably connected to the base;

a plurality of pulleys coupled to the base, including a drive pulley operatively connected to the drive motor and a movable pulley hingeably coupled to the base;

a belt formed into a belt loop wound around the plurality of pulleys, the belt loop having an interior surface contacting the pulleys and an exterior surface for supporting a pipe to be rotated;

a suspension member operatively coupled to the movable pulley; and a hydraulic damping member coupled to the suspension member.

23. The belt assembly of claim 22 wherein the hydraulic damping member is a shock-absorbing hydraulic cylinder.

24. The belt assembly of claim 22 wherein the hydraulic damping member resists belt detensioning movements of the moveable pulley.

* * * * *